United States Patent [19]

Cohen

[11] 4,252,137

[45] Feb. 24, 1981

[54] CONTINUOUSLY LENGTH ADJUSTABLE CRUTCH

[76] Inventor: Fernand A. Cohen, Leopoldsgatan 8, S-754 41 Uppsala, Sweden

[21] Appl. No.: 2,290

[22] Filed: Jan. 10, 1979

[30] Foreign Application Priority Data

Jan. 12, 1978 [SE] Sweden ..... 7800341

[51] Int. Cl.[3] ..... A61H 3/02

[52] U.S. Cl. ..... 135/69; 135/75

[58] Field of Search ..... 135/68, 69, 72, 75, 135/82, 83, 65

[56] References Cited

U.S. PATENT DOCUMENTS

| | | | |
|---|---|---|---|
| 3,157,188 | 11/1964 | Farnham | 135/69 |
| 3,416,546 | 12/1968 | Carpenter | 135/69 X |
| 3,486,515 | 12/1969 | Chrysostomides | 135/69 |

*Primary Examiner*—J. Karl Bell

*Attorney, Agent, or Firm*—Steele, Gould & Fried

[57] ABSTRACT

A continuously length adjustable crutch comprising two telescoping tube parts, a handle attached to one of the tube parts, and a locking mechanism for securing said two tube parts in relative position to each other, said crutch further comprising (a) a piston/cylinder unit containing a pressure fluid and having a piston rod attached to a first of said tube parts, a cylinder part attached to the second tube part, and a piston connected to the piston rod and slideable in the cylinder while sealing against the cylinder wall, said piston dividing the cylinder space containing the pressure fluid into two chambers communicating with each other by means of a normally closed connection conduit, the piston rod being locked relative to the cylinder when the connection conduit is closed, the pressure fluid tending to expell the piston rod from the cylinder when said connection conduit is open, and (b) actuator means for opening and closing said connection conduit.

12 Claims, 3 Drawing Figures

CONTINUOUSLY LENGTH ADJUSTABLE CRUTCH

Figure 1:
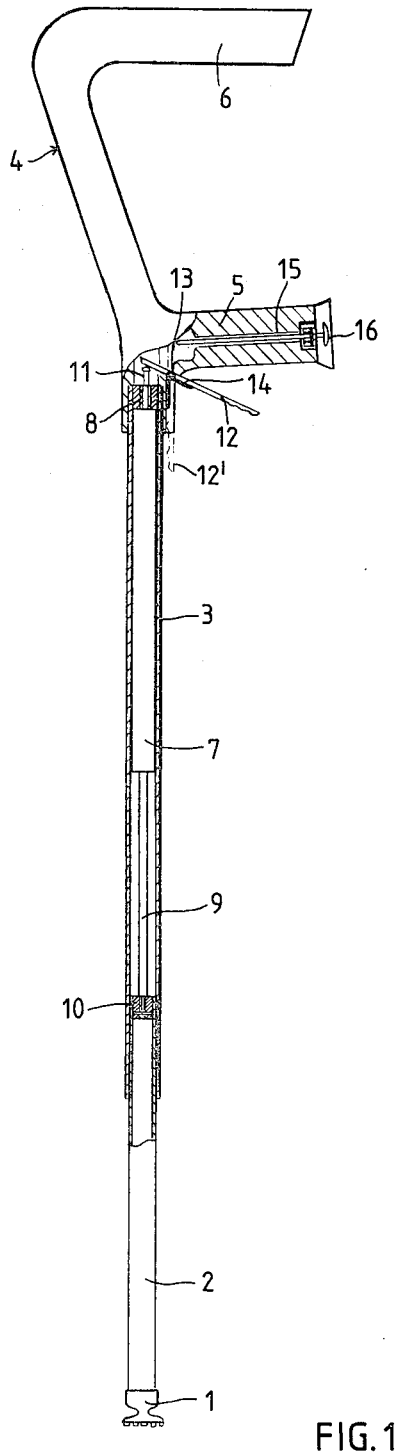

The present invention relates to a new type of crutches or crutch sticks to be used as a movement aid for temporarily or permanently handicapped persons. More particularly the invention relates to crutches which instantaneously and controllably can be adjusted in length during use, thereby, among other things, considerably facilitating the user's sitting down, raising up, using stairs, etc.

The length adjustable crutches presently available on the market basically consist of two telescoping tube parts which can be secured relative to each other by means of various mechanical locking devices arranged at regular intervals along the tube parts. A common design of the locking devices is that both of the tube parts are provided with diametrically opposed holes which can be placed in alignment with each other, the locking taking place by inserting a pin or the like through the holes in the two tube parts and securing the same in this position, for example by means of a lock nut or the like. The purpose of the length adjustability is in this case only to make it possible for a second person to re-use the same crutch. Thus, a suitable crutch length is found by testing for each individual patient, and once this length has been determined it is maintained until a new patient is to use the crutches, and only then is the length adjusted with regard to the new patient, and so on.

These prior art crutches have several disadvantages which, among other things, are related to the fact that the patient is unable to change the length of the crutch during use. For example, because of the fixed crutch length, the patient has little help when e.g. sitting down or raising up, but he must in such situations take support from arm rests, chair seats, etc. This is difficult for many patients and sometimes even impossible without help. Another disadvantage of known crutches is that they are practically completely unelastic and do not allow any resilience when being loaded.

It is an object of the present invention to eliminate these and other problems of prior art crutches, and it is a further object of the invention to provide a crutch with a very simple power reservoir, which without requiring any external power source offers an extra force for helping the user to raise from a sitting position, walk up stairs, etc.

To this end there is according to the invention proposed a crutch characterized by the features indicated in the subsequent claims and explained in more detail below.

One of the basic ideas of the invention is thus to make use of a piston/cylinder unit for connecting the two tube parts of a length adjustable crutch, comprising two telescoping tube parts and a grip part secured to the upper tube part, said grip part comprising a handle and preferably also a forearm support. The piston part is secured to one of the tube parts and the cylinder to the other tube part. The piston/cylinder unit contains a pressure fluid (pneumatic, hydropneumatic or hydraulic) tending to move the two tube parts apart from each other in any position, thereby extending the crutch. The piston/cylinder unit is further provided with a blocking device, which makes it possible to lock the piston part relative to the cylinder part, and consequently the upper tube part relative to the lower tube part, in any position such that total length of the crutch can be adjusted over a continuous range. Means for operating the blocking device are preferably associated with the handle part of the upper tube part, so that the user can control the blocking device instantaneously and controllably without releasing hold of the handle.

According to a preferred embodiment the piston/cylinder unit essentially consists of a cylinder, in which a piston is displaceable in an axial direction while sealing against the cylinder wall. The piston is in turn connected to a piston rod extending from the cylinder. The piston divides the cylinder space into two chambers containing pressure fluid. The two chambers communicate with each other by means of a connection conduit provided with a shut off valve or the like serving as said blocking device. The valve is normally closed, the piston/piston rod then being kept in a fixed position relative to the cylinder, with the exception of a certain spring action due to compression of the pressure fluid upon load. When the valve is opened (and the piston rod is not subjected to external load) the piston rod is extended because of the pre-stressing force, i.e. the pressure from the pressure fluid, which then flows from one cylinder chamber to the other through the connection conduit until the cut-off valve is closed or the piston reaches its end position (or the piston rod is loaded from the exterior by a counter acting force which is greater than the pre-stressing force, e.g. by the body weight of the user). This results in an extension of the crutch. If the user wishes to shorten the crutch, i.e. to push the piston/piston rod further into the cylinder, he opens the valve and charges the crutch, and thus the piston rod, through his body weight with a force greater than the pre-stressing force. The pressure fluid then flows in the opposite direction through the connection conduit. When the desired length has been reached, the user once again closes the cut-off valve to lock the tube parts relative to each other. In contrast to known length adjustable crutches, the patient himself can at will change the length of the crutch instantaneously during use. If he, for example, wishes to sit down he charges the crutch with his body weight and releases the blocking device, whereby the length of the crutch is automatically reduced and the body is lowered to a comfortable sitting position, in which he closes the blocking device. When the patient then wishes to raise up, the crutches have a suitable (shortened) length, so that he can conveniently raise up using the sticks as a support and simultaneously, or subsequently, once again lengthen the stick by releasing the blocking device. In doing so he can, by alternately transferring his body weight from one crutch to the other, make use of the force accumulated in the piston/cylinder units as a lifting aid. It should in this connection especially be noticed that no external power source is necessary for this accumulation of power, which in contrast takes place completely automatically when the patient with his body weight pushes the piston into the cylinder and thereby shortens the crutch.

According to a preferred embodiment of the invention the piston/cylinder unit is designed as a so-called gas spring, i.e. in which the pressure fluid is pneumatic or hydropneumatic. One of the advantages of using gas springs is that they can be designed for a flattened displacement/force curve ("spring constant"). Such gas springs, which are known per se, also have the advantage of offering a certain spring action by compression upon load, as is desirable in the present connection.

The initial pre-stressing force of the piston/cylinder unit, i.e. the prestress when the piston is completely extended, can be varied within rather broad limits, and any person having ordinary skill in the art can without any difficulties choose a suitable initial pre-stress according to the needs and desires in the specific case and with regard to the specific spring constant. Of course, the initial pre-stress and the spring constant should be adapted in such way that the user is able to push the piston into the cylinder over the entire interval of the length adjustment. In view thereof, the maximum accumulated force in the piston/cylinder unit should not be greater than about 25 kg and preferably not less than about 15 kg. The difference between the greatest and the smallest pre-stressing force is, as mentioned above, preferably as small as possible, and it is primarily decided by the cylinder stroke, the cylinder diameter to piston rod diameter ratio and the choice of the pressure fluid.

Figure 2:
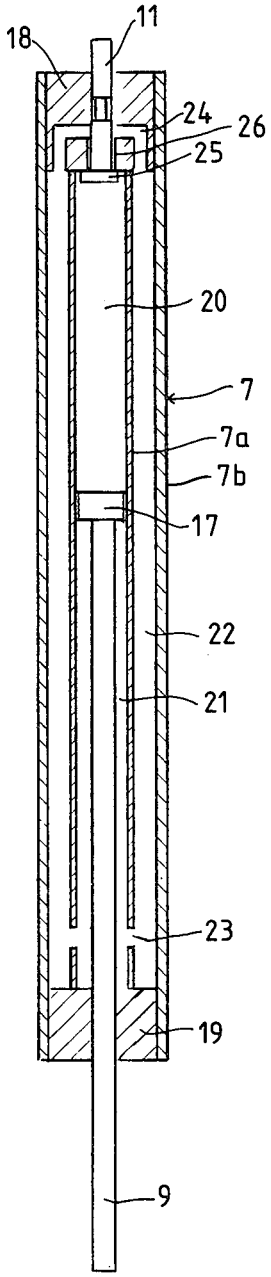
Figure 3:
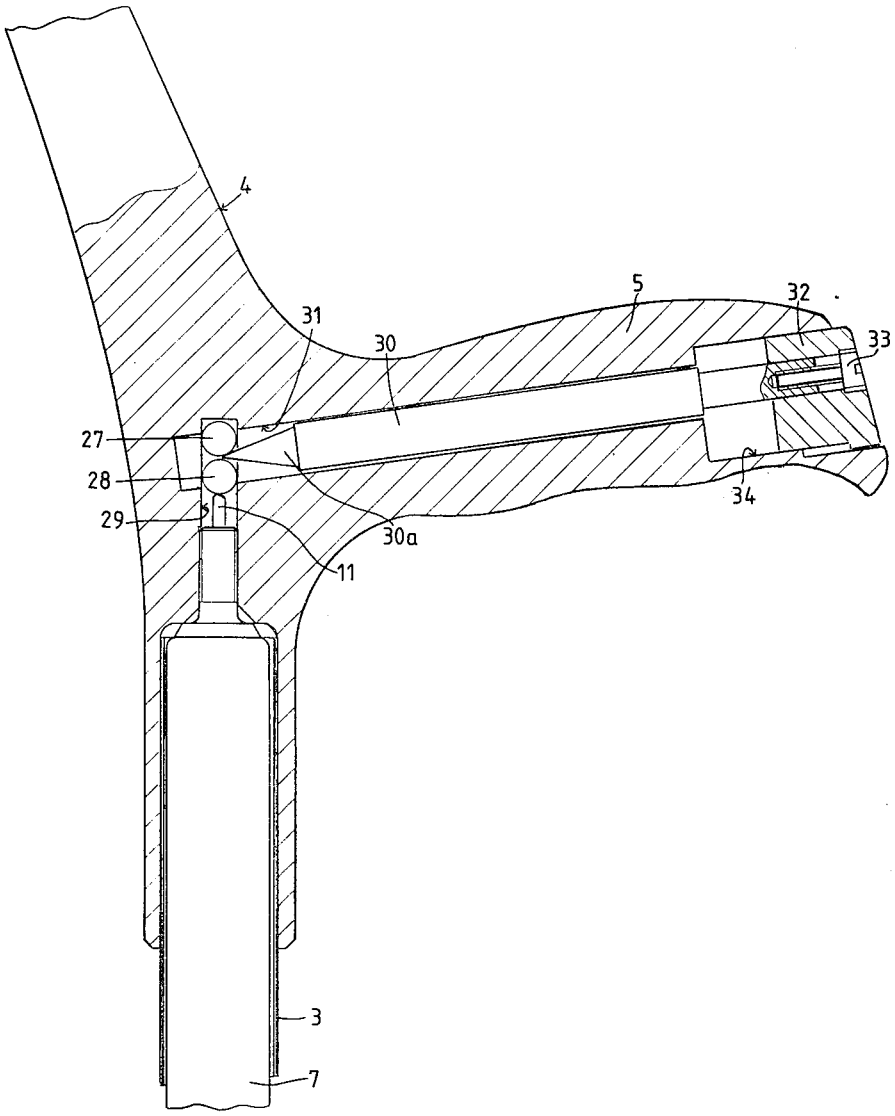

The invention will be described in more detail in the following non-limiting description of a preferred embodiment, with reference to the enclosed drawings, in which FIG. 1 is a schematic partial view in longitudinal section, illustrating a preferred embodiment of a crutch according to the invention, FIG. 2 is a schematic view in longitudinal section illustrating the operation of the piston/cylinder unit of the crutch according to FIG. 1, and FIG. 3 is a schematic sectional view illustrating an alternative embodiment of the means for operating the piston/cylinder unit according to the invention.

The crutch illustrated in FIG. 1 in conventional manner comprises a tip 1 which is secured to a lower tube 2. The tube 2 is telescopically displaceable in an upper tube 3. A grip part 4 comprising a handle 5 and a bow-shaped forearm support 6 is secured to the top portion of the tube 3. The top edges of the support 6 are preferably located in the same plane and are designed in such a manner that the crutch, when not being used, can be placed on a planar support using said edges as a rest surface. According to the invention a pneumatic, hydropneumatic or hydraulic cylinder 7 is attached to the upper tube 3 in any suitable manner. The cylinder can e.g. be welded or screwed to the tube 3 as illustrated at 8. A piston rod 9 extending from the cylinder 7 and being actuated by the pressure fluid in the cylinder 7 is attached to the lower tube 2 in any suitable manner, as illustrated at 10. As explained in more detail below with reference to FIG. 2, the end of the piston rod 9 located in the cylinder 7 is provided with a piston 17 sealingly defining an upper and a lower chamber for pressure fluid in the cylinder 7. Said two chambers communicate with each other by means of a normally closed connection conduit. The cylinder shown in FIG. 1 is at the top provided with a pin 11 extending in an axial direction. When depressed, the pin 11 opens the normally closed connection between the two pressure fluid chambers of the cylinder 7 (see FIG. 2). The pin 11 is, in the embodiment of FIG. 2, depressed by means of one arm of a double armed control lever 12 journalled on an axis 13. A spring 14 gives the control lever 12 certain pre-stress so that one end thereof contacts the pin 11, but does not depress the same so as to open the communication between the two pressure fluid chambers of the cylinder 7. The opposite arm of the control lever 12 is located to be easily accessible below the handle 5 (and is biased against the same) so that the user can operate the arm by means of his fingers without loosening his grip on the handle 5. When the user moves this arm against the handle 5, the opposite end of the control lever will thus depress the pin 11, thereby opening the connection between said pressure fluid chambers. The described operative position for the control lever 12, i.e. with one arm contacting the pin 11 without depressing the same and with the other arm located at a suitable distance from the handle 5, is illustrated by the full lines in FIG. 1. The control lever 12 can preferably also be moved to a completely inactive position, in which no unintentional operation of the pin 11 can take place. In this position, which in FIG. 1 is designated by 12' and is marked in dashed lines, the control lever 12 is arranged essentially parallel with the tube 3 and may be recessed in the same. The control lever is brought to this position by rotation around the axis 13 (under resistance from the spring 14), and it is kept in place in a suitable manner, e.g. by means of a snap-in locking device. In the illustrated embodiment the arm of the control lever cooperating with the pin 11 contacts a control rod 15 extending within the handle 5. The control rod 15 is provided with a head 16 at its opposite end. When the user wishes to move the control lever from the inactive position 12' to the working position 12 he depresses the control rod 15 by means of the head 16, thereby causing the control rod 15 to pivot the control lever around the axis 13 and release the same from the snap-in locking device. The control lever is thereby moved to the working position 12 by the action of the spring 14.

FIG. 2 schematically illustrates a preferred design of the piston/cylinder unit used in the crutch according to the invention. As mentioned above the piston rod 9 is connected to a piston 17 sliding in the cylinder 7 while sealing against the cylinder wall. The piston 17, together with the cylinder 7, an upper end closure 18 and a lower end closure 19, divides the cylinder space into an upper chamber 20 and a lower chamber 21. The chambers 20, 21 communicate by means of a normally closed conduit. In the illustrated case said connection conduit is formed by the cylinder 7 having an inner wall **7*a* and an outer wall 7*b* defining an annular channel 22. One or more openings 23 provided in the lower portion of the inner cylinder wall 7*a* (alternatively in the end closure 19) connect the lower cylinder chamber 21 with the channel 22, whereas the upper cylinder chamber 20 can be brought into communication with the channel 22 by means of one or more passages 24 provided in the end closure 18. The pin 11 extends through a central bore in the end closure 18 and is, at the end located in the cylinder chamber 20, provided with a valve disc 25, which normally sealingly contacts a corresponding seat of the end closure 18 because of the pressure in the chamber 20. When the pin 11 is depressed, the valve disc 25 is removed from its seat and opens the connection between the cylinder chambers 20 and 21 by means of the openings 23, the channels 22 and 24 and an annular channel 26 provided around the pin 11 in the end closure 18 between the channels 24 and the upper cylinder chamber 20. If the piston rod 9 is not loaded from the exterior (e.g. by the body weight of the user) pressure fluid will then flow from the chamber 21 to the chamber 22, pushing the piston 17/piston rod 9 outwardly until the depression of the pin 11 ceases (or the piston rod 9** reaches its end position or is loaded from the exterior by a force greater than the prestressing force of the piston/cylinder unit because of the pressure fluid). Thus, the length of the crutch increases (see FIG.

1). If the user, when the pin 11 is depressed, transfers a part of his body weight to the crutch and thereby charges the piston rod 9 with a force greater than the counteracting force from the pressure fluid, then the pressure fluid will flow in the opposite direction, i.e. from the chamber 20 to the chamber 21 of the cylinder 7. The crutch then becomes shorter, the load through the body weight thus causing a power accumulation in the piston/cylinder unit. The accumulated power can subsequently be utilized by the user as extra power assistance when lengthening the crutch, e.g. when the user (who uses a pair of crutches) wishes to raise up from a sitting position. It should in this connection be noticed that the opening and closing of the connection between the cylinder chambers 20 and 21 can take place very rapidly, whereas the length adjustment preferably takes place in a comparatively slow and soft movement, so that the user very rapidly and safely can set exactly the desired length of the crutch.

FIG. 3 illustrates an alternative design of the mechanism for depressing the pin 11. In this embodiment the pin is depressed by two balls 27 and 28 located in a cylinder bore 29 provided in the grip portion 4 and being coaxial with the pin 11. A push rod 30 is mounted in a second bore 31, extending through the handle 5 essentially perpendicularly to the first bore 29. The rod 30 has a conical end portion 30*a*, which contacts the two balls 27, 28. The opposite end of the rod 30 is provided with a push-button 32, attached to the rod 30 in any suitable manner, e.g. by means of a screw 33 or by being made integral with the rod 30. The push-button 32 is mounted in a corresponding bore 34 in the handle 5, and means (not shown) are provided for preventing the push-button 32 from escaping from the bore 34. When the user depresses the push-button 32 (e.g. by means of his thumb), the rod portion 30*a* penetrates between the two balls 27 and 28, thereby forcing the ball 28 to depress the pin 11 for opening the valve 25 (see FIG. 2). When the push-button 32 is released, the pressure of the pressure fluid in the cylinder 7 closes the valve 25, thereby forcing the pin 11 to push the ball 28 and the rod 30 back to the original position (i.e. the position shown in FIG. 3).

The invention is, of course, not restricted to the embodiments described above and illustrated in the drawings, but many modifications and variations are possible within the scope of the general invention idea.

What I claim is:

1. A continuously length adjustable crutch comprising:

(a) two telescoping tube parts;

(b) a handle attached to an upper of said tube parts;

(c) a piston/cylinder unit built in said tube parts and interconnecting the same, said piston/cylinder unit comprising:

(d) a cylinder attached to one of said tube parts and containing a pressure fluid;

(e) first and second end plugs closing said cylinder and defining cylinder walls and a cylinder space therein;

(f) a piston rod having one end thereof attached to a second of said two parts and sealingly extending through one said end plugs into said cylinder space;

(g) a piston connected to a free end of said piston rod and slideable in said cylinder while sealing against the cylinder wall, said piston dividing said cylinder space into a lower and an upper pressure fluid chamber;

(h) conduit means interconnecting said lower and upper pressure fluid chambers;

(i) valve means in said conduit means for opening and closing said conduit means, said piston rod being locked relative to said cylinder, and two tube parts being locked relative to each other, when said conduit means is closed, and said pressure fluid tending to expel said piston rod from said cylinder when said conduit means is open; and, (j) manually operable means control for opening and closing said valve means.

2. A crutch according to claim 1, wherein said valve means comprises a normally closed cut-off valve, arranged to be openable by operation of said control means.

3. A crutch according to claim 2, wherein said cut off valve is kept in the closed position by the action of said pressure fluid.

4. A crutch according to claim 3, wherein said cut-off valve comprises a pin axially extending from said cylinder, said pin opening said connection conduit when depressed.

5. A crutch according to claim 4, wherein said control means comprises means for depressing said pin.

6. A crutch according to claim 1, wherein said pressure medium is a gas.

7. A crutch according to claim 1, wherein said pressure medium is a gas/oil mixture.

8. A continuously length adjustable crutch comprising:

(a) upper and lower telescoping tube members;

(b) a handle attached to the upper telescopic member; and, (c) a manually operable, self-contained energy accumulator, comprising:

(1) a piston/cylinder assembly, having a piston rod attached within one of the telescopic members, a cylinder attached within the other of the telescoping members, the piston dividing the cylinder into two chambers;

(2) an operating pressure fluid in the cylinder;

(3) a conduit connecting the chambers, being normally closed and locking the relative position of the telescoping members; and, (4) manually operable control means for opening and closing the conduit, the fluid tending to expel the piston from the cylinder when the conduit is open;

(d) whereby an individual leaning on the crutch can be gently lowered by opening the conduit, energy being accumulated by compression of the fluid by the piston, and stored by closing the conduit after the lowering, and subsequently, can utilize the stored energy for rising, by reopening the conduit and permitting the fluid to expel the piston and lengthen the crutch.

9. A crutch according to claims 1 or 8, wherein said control means are associated with said handle for enabling operation of the control means while gripping the handle.

10. A crutch according to claim 9, wherein said handle comprises a push-button, which when depressed opens said valve means.

11. A crutch according to claim 10, wherein said push-button is secured to one end of a push rod, the other end of which cooperates with a pair of balls for separating the same when said push-button is depressed, one of said balls then depressing said pin for opening said valve means.

12. A crutch according to claims 2 or 8, wherein said cylinder has an inner wall and a substantially concentric outer wall, a substantially annular space being defined therebetween, said annular space forming part of said conduit means interconnecting said two pressure fluid chambers.

* * * * *